US005149928A

United States Patent [19]

Kamp

[11] Patent Number: 5,149,928

[45] Date of Patent: Sep. 22, 1992

[54] ARC SPINNER INTERRUPTER HAVING CONTACT BOUNCE SUPPRESSOR

[75] Inventor: Eugene L. Kamp, Fulton, Mo.

[73] Assignee: A. B. Chance Company, Centralia, Mo.

[21] Appl. No.: 763,327

[22] Filed: Sep. 20, 1991

[51] Int. Cl.[5] ..... H01H 33/18; H01H 3/60

[52] U.S. Cl. ..... 200/147 R; 200/288

[58] Field of Search ..... 200/147 R, 147 A, 147 B, 200/147 C, 147 D, 286–288

[56] References Cited

U.S. PATENT DOCUMENTS

| | | | |
|---|---|---|---|
| 4,409,446 | 10/1983 | Parry | 200/147 R |
| 4,980,527 | 12/1990 | Eppinger | 200/147 C |
| 5,015,810 | 5/1991 | Eppinger et al. | 200/147 R |

*Primary Examiner*—J. R. Scott

*Attorney, Agent, or Firm*—Hovey, Williams, Timmons & Collins

[57] ABSTRACT

An arc spinner interrupter apparatus includes a first electrical contact assembly having a fixed contact and an arcing element. A second electrical contact assembly includes an arm selectively movable along a path into and out of engagement with the fixed contact. The arcing element extends beyond the fixed contact in a direction parallel to the path of the arm and is biased toward a position at least partially within the path of movement such that the arm impacts and engages the arcing element during movement toward the fixed contact. A mass is biased toward a position in contact with the arcing element for dampening oscillation of the arcing element in a direction transverse to the path of movement. When the arm impacts the arcing element the kinetic energy of the arcing element acting in the transverse direction is transferred from the element to the mass and oscillation of the element is reduced.

7 Claims, 1 Drawing Sheet

ARC SPINNER INTERRUPTER HAVING CONTACT BOUNCE SUPPRESSOR

BACKGROUND OF THE INVENTION

1. Field of the Invention

The present invention relates generally to electrical arc interrupter devices and, more particularly, to an arc spinner interrupter having a bounce suppressor for dampening transverse oscillations of a contact element.

2. Discussion of the Prior Art

Examples of an arc spinner interrupter apparatus are illustrated in U.S. Pat. Nos. 4,980,527 and 5,015,810. In each of these devices, an interrupter apparatus includes a fixed electrical contact assembly, a ring electrode spaced from the fixed contact assembly, a field coil surrounding the ring electrode, and a second electrical contact assembly having an arm movable into and out of engagement with the fixed contact assembly.

An L-shaped stationary arc tip is provided on the fixed contact and extends beyond the fixed contact by a predetermined distance. The stationary arc tip is constructed of a resilient conductive metallic material having suitable arc resistant properties. During operation of the interrupter apparatus, as the arm moves out of contact with the fixed contact, an arc is prevented from forming between the arm and the fixed contact due to the engagement of the arc tip with the arm. Once the arm moves beyond the arc tip, an arc forms therebetween and is extinguished in a manner discussed more fully in the referenced patents, both of which are incorporated herein by this reference.

Thus, a primary function of the arc tip in the known interrupter apparatus is to prevent the formation of an arc between the fixed contact and the arm and to postpone for as long as possible the formation of the arc during opening of the interrupter contacts. However, because of the resilience of the arc tip, it is possible for the tip to bounce away from the arm as the section is moved relative to the fixed contact. Such bouncing permits arcing to occur between the arm and both the arc tip and the fixed contact such that unwanted, excessive arcing occurs, and erosion of the material of the contacts is expedited.

OBJECTS AND SUMMARY OF THE INVENTION

It is an object of the present invention to provide an arc interrupter apparatus in which arcing is controlled so as to occur only between thermally resistant elements provided on each of the contacts. In this manner, erosion of the contacts is reduced in order to lengthen the useful life of the apparatus.

It is another object of the invention to provide an arc interrupter apparatus in which a contact element is maintained in engagement with a movable contact during movement of the contact within the vicinity of a fixed contact such that arcing between the movable and fixed contacts is controlled.

In accordance with these and other objects evident from the following description, an arc interrupter apparatus constructed pursuant to the present invention includes a fixed electrical contact assembly and a ring electrode having first and second axial ends and defining a central longitudinal axis. A field coil surrounds the ring electrode, and means are provided for electrically coupling the ring electrode to the fixed contact assembly through the field coil so that a magnetic field is created within the ring electrode during current flow through the field coil.

A second electrical contact assembly is provided having an arm which is selectively movable along a path into and out of engagement with the fixed contact assembly. The fixed contact assembly includes an arcing element extending in a first direction generally parallel to the path of movement of the arm and being biased toward a position at least partially within the path of movement such that the arm impacts and engages the arcing element during movement toward the fixed contact assembly. Means are provided for dampening oscillation of the arcing element in a second direction transverse to a plane defined by the path of movement of the arm. The dampener means includes a mass and biasing means for biasing the mass toward a position in contact with the arcing element so that when the arm of the second contact assembly impacts the arcing element the kinetic energy of the arcing element acting in the second direction is transferred from the arcing element to the mass and oscillation of the arcing element is reduced.

By this construction, numerous advantageous results are achieved. For example, by providing an arcing element and means for dampening oscillation thereof, it is possible to ensure that arcing between the movable arm and the fixed contact assembly occurs between the arcing element and the arm. In this manner, the location of arcing is controlled and thermally resistant material may be added to this location in order to reduce the amount of erosion caused by such arcing.

Further, because the arcing element remains in contact with the arm and does not bounce out of contact therewith, no arcing is permitted to occur between the arm and any areas of the fixed contact assembly other than at the arcing element. By controlling the timing and position of arcing in this way, closure of the contacts of the interrupter apparatus occurs in a controlled manner.

BRIEF DESCRIPTION OF THE DRAWING FIGURES

A preferred embodiment of an arc interrupter apparatus constructed in accordance with the present inventions is described in detail below with reference to the attached drawing figures, wherein.

DETAILED DESCRIPTION OF THE PREFERRED EMBODIMENT

Figure 1:
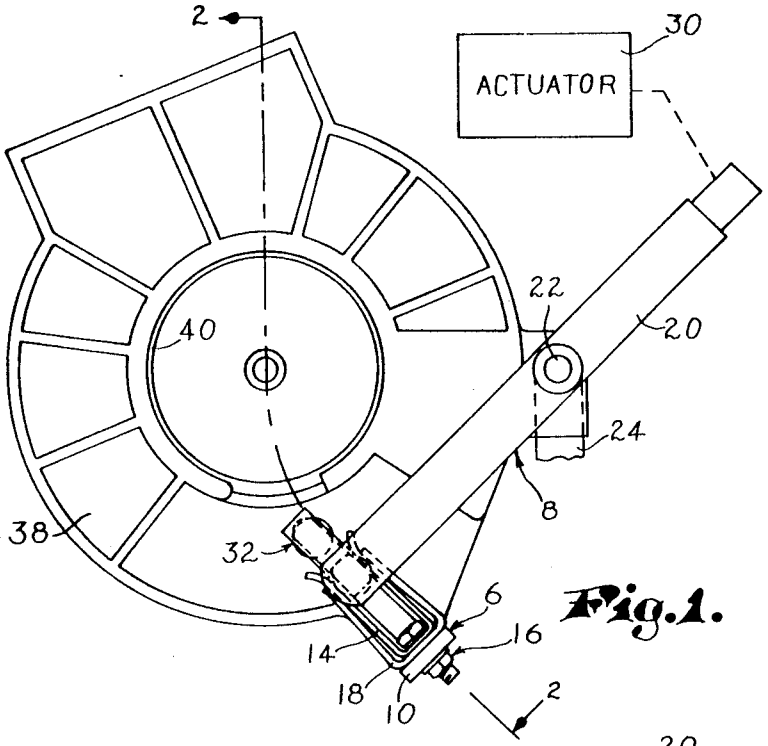
FIG. 1 is a plan view of an arc interrupter apparatus made in accordance with the preset invention.

An arc interrupter apparatus constructed in accordance with the present invention for use in electrical switchgear is illustrated in FIG. 1. Although not shown in the drawing, the apparatus is preferably disposed within a housing filled with an insulating gas having favorable arc extinguishing properties. For example, sulfur hexafluoride may be employed as an insulating gas because of the many advantages offered by a gas of that type. Sulfur hexafluoride is an inert, non-toxic, nonflammable gas that is an excellent dielectric. In addition, because the gas is electronegative it is an excellent arc extinguishing material.

A pair of bushings preferably extend through the housing in a sealed manner and are adapted to be connected to the arc interruption apparatus. One of the bushings is adapted to be connected to a fixed contact assembly 6 of the apparatus while the other bushing is connected to a movable contact assembly 8, so that the current path from a distribution line or the like extends from one of the bushings through the fixed contact assembly and the movable contact assembly to the second bushing.

The fixed contact assembly 6 includes a support arm 10 and a fixed U-shaped contact 14 secured to the support arm by suitable means such as a bolt and nut 16 arrangement. A U-shaped biasing element 18 is sandwiched between the contact 14 and the arm 10 and includes two legs extending along the outer faces of the legs of the contact. The legs of the biasing element 18 press inward against the legs of the contact 14 in order to bias the legs of the contact toward one another.

Figure 3:
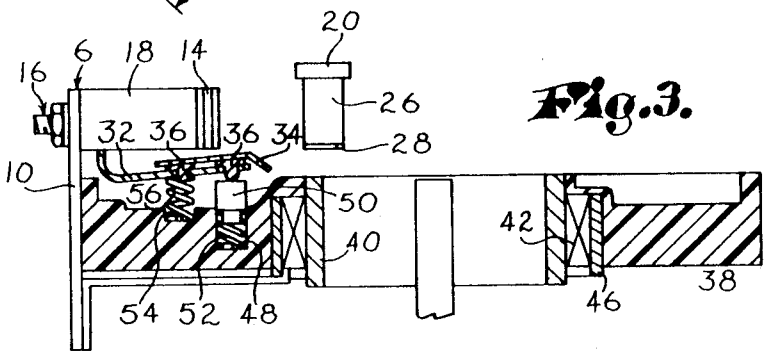
FIG. 3 is a cross-sectional view similar to FIG. 2, illustrating the contacts in an open position.

The movable contact assembly 8 includes an elongated arm 20 having a hole located intermediate the ends thereof through which a pivot pin 22 extends. The arm 20 is held in pressing engagement with a busbar 24 by the pivot pin 22 which may be spring loaded to a predetermined force. The busbar 24, in turn, is connected with one of the bushings. Preferably, the arm 20 includes an L-shaped configuration, having an angled portion 26 extending in a direction generally parallel to the pivot axis, as shown in FIG. 3. The angled portion 26 is sized for receipt between the legs of the fixed contact 14, and includes a lower end provided with a button 28 formed of thermally resistant material such as a tungsten alloy or the like.

Figure 2:
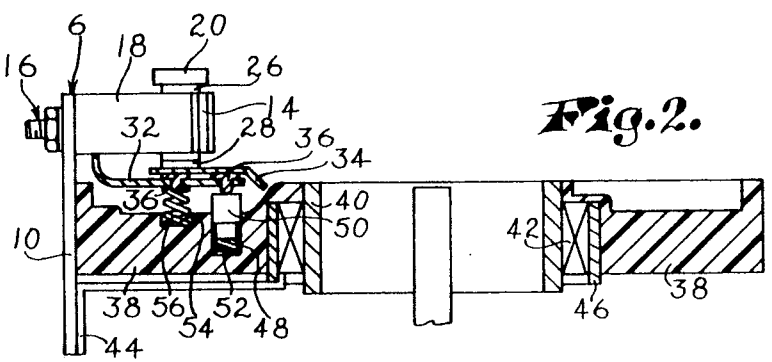
FIG. 2 is a cross-sectional view of the interrupter apparatus of FIG. 1, taken along line 2—2, illustrating the contacts in a closed position.

An actuator 30 is provided in the apparatus for carrying out movement of the arm 20 between a closed, current-carrying position, as shown in FIG. 2, and an interrupted position as shown in FIG. 3. The actuator 30 is preferably connected to the arm 20 for moving arm relative to the fixed contact assembly 6.

An L-shaped arcing element 32 is provided on the fixed contact assembly 6 and is also mounted on the arm 10 by the bolt and nut arrangement 16. One leg of the L-shaped element 32 extends beyond the legs of the contact 14 by a predetermined distance. The arcing element 32 is constructed of a resilient, conductive, metallic material having suitable arc resistant properties. For example, the arcing element 32 may be a phosphor bronze leaf spring.

Preferably, the arcing element 32 is provided with a tip 34 formed of thermally resistant material, such as a tungsten alloy, which is secured to the arcing element 32 provides a contact surface that is engaged by the arm 20 during movement of the arm relative to the fixed contact assembly 6. The tip 34 is held on the arcing element 32 by a of rivets 36 or the like.

A support 38 is provided and is of generally annular shape including an inner radial surface which extends axially in a direction parallel to the pivot axis of the movable contact assembly 8. The fixed contact assembly 6 is mounted on an outer radial surface of the support 38 at a position circumferentially spaced from the position at which the pivot pin 22 is mounted. An arc interrupting ring electrode 40 is disposed within the opening of the support 38 and includes opposed axial ends defining a central longitudinal axis therebetween. The arc interrupting ring electrode 40 is formed of a conductive material and is of generally hollow cylindrical shape. One end of the ring electrode 40 is closely surrounded by the insulating material of the support 38 which is flush with the end of the ring electrode 40 and extends radially outward therefrom to the support arm 10.

A field coil 42 surrounds the ring electrode 40 and is formed by a w of conductive strip material. The field coil 42 is in contact with the ring electrode 40 and is connected with the fixed contact 14 by a lead or busbar 44 extending between the outer winding of the coil and the support arm 10. Thus, the ring electrode 40 is connected through the field coil 42 to the fixed contact assembly 6. A reinforcing ring 46 is disposed on the outer circumference of the field coil 42 and is fitted, along with the field coil 42 into an annular stepped portion of the inner radial surface of the support 38. The runforcing ring 46 is preferably constructed of steel to give mechanical rigidity to the ring electrode 40 field coil 42.

The support 38 is provided with a first cylindrical recess positioned adjacent the end of the arcing element 32 and extending in a direction parallel to the longitudinal axis defined by the ring electrode 40. A mass 50 of cylindrical shape is sized for receipt in the recess and includes a stepped portion of reduced diameter adapted to be received within the inner diameter of a compression spring 52 which is positioned in the recess beneath the mass 50. The compression spring 52 exerts a force on the mass 50 which is sufficient to hold the mass in contact with the arcing element 32 but which is small enough to permit the mass to be into the recess by the arcing element.

A second recess 54 is provided between the first recess 48 and the support arm 10 and is adapted to receive a compression spring 56 which provides a biasing force against the arcing element 32 urging the element toward a as shown in FIG. 3, wherein the arcing element 32 is disposed at least partially within the path of travel of the angled portion of the arm 20. The compression spring 52 acting on the mass 50 does not provide a biasing force against the arcing element 32, but rather merely holds the mass in contact with the arcing element.

In operation, when the arm 20 of the movable contact assembly 8 is retained by the fixed contact 14, current flows through the apparatus. In order to interrupt this current flow, the actuator 30 moves the arm 20 from the position shown in FIG. 2 toward the position in FIG. 3. During this movement, the arm 20 first breaks contact with the legs of the fixed contact 14 while the button 28 at the lower end of the angled portion 26 remains in engagement with the tip 34 of the arcing element 32. During continued movement of the arm 20, the button 28 slides off of the tip 34 and the compression spring 56 urges the leg of the arcing element 32 toward the position shown in FIG. 3, wherein the tip is disposed within the path of the arm 20. An arc forms between the tip of the arcing element 32 and the button 28 of the arm 20 because the distance between these elements is the shortest distance between the fixed contact assembly 6 and the movable contact assembly 8. As the arm 20 moves away from the fixed contact assembly 6 toward the center of the ring electrode 40, the arc is extinguished in a manner as described more fully in U.S. Pat. Nos. 4,980,527 and 5,015,810.

During closing of the apparatus, the arm 20 moves toward the fixed contact assembly 6 and the button 28 of the angled portion 26 impacts and engages the tip 34 of the arcing element 32 which is disposed within its path. Upon being impacted by the arm 20, the arcing element 32 moves laterally out of the path of travel of the arm in a direction generally parallel to the longitudinal axis of the ring electrode 40. Because of the resiliency of the material used in the arcing element 32 and due to the nature of the biasing force exert on the arcing element 32 by the compression spring 56, the leg of the arcing element 32 would normally tend to oscillate and would repetitively slap against and bounce away from the button 28 after the initial impact, permitting arcs to form between the arcing element 32 and both the button 28 and the fixed contact 14 whenever the arcing element 32 moved apart from the arm 20. However, by providing dampening means 50, 52 and 56 of the present invention, the kinetic energy of the arcing element in the direction transverse to the path of travel of the arm 20 is transferred to the mass 50 and the tip of the arcing element 32 remains in contact with the button 28 of the arm 20, thus preventing the formation of arcs between the fixed and movable contacts.

By providing the dampening means of the present invention, the arcing element 32 is retained in contact with the button 28 of the arm 20 so that arcing is prevented from occurring elsewhere between the fixed and movable contact assemblies 6 and 8, and is permitted only between the tip 34 of the arcing element 32 and the button 28 of the arm 20, both of which are formed of thermally resistant material to withstand the high temperatures normally accompanying arcing.

Although the invention has been described with reference to the preferred embodiment illustrated in the drawing figures, it is understood that equivalents may be employed and substitutions made herein without departing from the scope of the invention as set forth in the claims.

What is claimed is:

1. An arc spinner interrupter apparatus comprising:

a fixed electrical contact assembly;

a ring electrode having first and second axial ends and defining a central longitudinal axis;

a field coil surrounding the ring electrode;

means for electrically coupling the ring electrode to the fixed contact assembly through the field coil so that a magnetic field is created within the ring electrode during current flow through the field coil;

a second electrical contact assembly having an arm which is selectively movable along a path into and out of engagement with the fixed contact assembly, the fixed contact assembly including an arcing element extending in a first direction generally parallel to the path of movement of the arm and being biased toward a position at least partially within the path of movement such that the arm impacts and engages the arcing element during movement toward the fixed contact assembly; and dampener means for dampening oscillation of the arcing element in a second direction transverse to a plane defined by the path of movement of the arm, the dampener means including a mass and biasing means for biasing the mass toward a position in contact with the arcing element so that when the arm of the second contact assembly impacts the arcing element the kinetic energy of the arcing element acting in the second direction is transferred from the arcing element to the mass and oscillation of the arcing element is reduced.

2. The arc spinner interrupter apparatus as recited in claim further sing insulating material disposed radially outward of the first axial end of the ring electrode between the ring electrode and the fixed electrical contact assembly, the dampener means being supported within the insulating material.

3. The arc spinner interrupter apparatus as recited in claim wherein the arcing element includes a generally L-shaped body having a first end secured to the fixed electrical contact assembly and a second free end extending in the first direction, and a tip of thermally resistant material attached to the second end of the L-shaped body.

4. The arc spinner interrupter apparatus as recited in claim 1, wherein the dampener means further includes secondary biasing means for biasing the second end of the L-shaped body toward the position at least partially within the path of movement of the arm.

5. The arc spinner interrupter apparatus as recited in claim 4, wherein the secondary biasing means is a compression spring.

6. The arc spinner interrupter apparatus as recited in claim 2, wherein the insulation material includes a recess for receiving the mass and the means for biasing the mass, and for guiding the mass for movement in the second direction.

7. A switch comprising:

a first electrical contact;

a second electrical contact having an arm which is selectively movable along a path into and out of engagement with the fixed contact, the fixed contact including an arcing element extending in a first direction generally parallel to the path of movement of the arm and being biased toward a position at least partially within the path of movement such that the arm impacts and engages the arcing element during movement toward the fixed contact; and dampener means for dampening oscillation of the arcing element in a second direction transverse to a plane defined by the path of movement of the arm, the dampener means including a mass and biasing means for biasing the mass toward a position in contact with the arcing element so that when the arm of the second contact assembly impacts the arcing element the kinetic energy of the arcing element acting in the second direction is transferred from the arcing element to the mass and oscillation of the arcing element is reduced.

* * * * *